US010184495B2

(12) United States Patent
Iyer et al.

(10) Patent No.: US 10,184,495 B2
(45) Date of Patent: Jan. 22, 2019

(54) AIR MOVEMENT APPARATUS WITH IMPROVED AIR BLENDING

(71) Applicant: Lasko Holding, Inc., Wilmington, DE (US)

(72) Inventors: Vasanthi Iyer, Wilmington, DE (US); William Lewis, Denver, PA (US); Phillip Lee, Collegeville, PA (US)

(73) Assignee: LASKO HOLDINGS, INC., Wilmington, DE (US)

( * ) Notice: Subject to any disclaimer, the term of this patent is extended or adjusted under 35 U.S.C. 154(b) by 621 days.

(21) Appl. No.: 14/091,586

(22) Filed: Nov. 27, 2013

(65) Prior Publication Data

US 2014/0147297 A1 May 29, 2014

Related U.S. Application Data

(60) Provisional application No. 61/797,047, filed on Nov. 28, 2012.

(51) Int. Cl.
*F04F 5/14* (2006.01)
*F04D 29/58* (2006.01)
*F24F 1/01* (2011.01)

(52) U.S. Cl.
CPC ..... *F04F 5/14* (2013.01); *F04D 29/5826* (2013.01); *F24F 1/01* (2013.01)

(58) Field of Classification Search
CPC ..... F04F 5/46; F04F 5/466; F04F 5/16; F04F 5/14; F04F 1/01; F24F 1/01
USPC ..... 417/176, 177
See application file for complete search history.

(56) References Cited

U.S. PATENT DOCUMENTS

| | | | | |
|---|---|---|---|---|
| 6,760,543 | B1 * | 7/2004 | Orr | F24H 9/1872 392/360 |
| 7,699,580 | B2 | 4/2010 | Lasko et al. | |
| 8,212,187 | B2 | 7/2012 | Lasko | |
| 2009/0120925 | A1 * | 5/2009 | Lasko | F24H 3/0411 219/386 |
| 2010/0226797 | A1 * | 9/2010 | Fitton | F04D 25/08 417/313 |

* cited by examiner

*Primary Examiner* — Philip Stimpert
(74) *Attorney, Agent, or Firm* — Pepper Hamilton LLP

(57) ABSTRACT

A portable air movement apparatus with improved air blending is provided, having a housing, an air generator, an air outlet, and an ambient air passageway through the housing of the device. The impeller and other components, such as the heating element, are disassociated from the location of the air outlet, allowing for the ability to use more than one air outlet, which serves to spread the air stream over a greater area. The disassociation of the impeller and other components from the air outlet also minimizes the housing size required near the air outlet, thereby allowing ambient air to be entrained in the air flow produced by the apparatus. As such, the apparatus moves more room air through the apparatus and more rapidly blends the air into the entire area or room.

13 Claims, 8 Drawing Sheets

* =110
** =164
*** =180

AIR MOVEMENT APPARATUS WITH IMPROVED AIR BLENDING

CROSS-REFERENCE TO RELATED APPLICATIONS

This application claims priority to U.S. Provisional Patent Application No. 61/797,047 filed Nov. 28, 2012, which is incorporated herein by reference in its entirety.

TECHNOLOGY FIELD

The present invention relates generally to a portable air movement apparatus. More specifically, the present invention relates to portable heaters and fans with improved air blending characteristics.

BACKGROUND

Portable air moving apparatuses have been used for many years to cool and heat a specific area. The ability to confine the effects of the device to the specific area in which the user is located compared to the need to heat or cool an entire building results in saving energy.

Conventional portable air moving apparatuses commonly locate the impeller proximate the air outlet of the device. If the apparatus is used for heating, the additional components, such as the heating element, are also located near the heated air outlet of the device. These conventional structures are designed to accomplish an efficient and direct flow of air from the impeller and to immediately expel the air from the device. In an effort to achieve air flow efficiency, conventional air moving apparatus require that the housing shape and form located proximate the air outlet be of sufficient size to enclose the impeller and/or heating element. Additional structures, such as motor mountings, scroll housings (used with centrifugal impellers), air guides and air cut-offs (used with transverse impellers), for example, further increase the required housing dimension necessary to accommodate the proximate location relationship between the impeller, heating element, air outlet and other components.

One disadvantage of conventional portable air moving apparatus is that the required size of the housing near the air exit impedes the ability of the device to entrain ambient air into the generated air stream. For example, entrainment of ambient air into a heated air stream as it exits the device would have an effect of increasing the overall temperature of a greater quantity of air in a room. In effect, such a device would more directly accomplish the goal of space heater use. This goal is, to some extent, impeded by the structure of conventional space heaters.

Additionally, a conventional portable air moving device utilized to heat the air requires specific and/or carefully controlled air flow characteristics. This is needed to assure that the air flow is heated properly as it passes through the heating element. Such air flow characteristics include, for example, air velocities, air volumes, and the like. As such, the proximity of the impeller relative to the heating element and the desire of locating the heating element immediately proximate the air outlet limits the ability of the device to have multiple heated air outlets. Each of said air outlets would require a discrete heating element and possibly a discrete impeller. The additional parts within the structure increase the cost and complexity of the devise.

SUMMARY

In view of the deficiencies of the prior art, the following is a description of an air moving apparatus with improved air blending characteristics.

As described, the ability to disassociate the impeller and other components, such as the heating element, from the location of the air outlet promotes the ability to cost effectively use more than one air outlet. The use of multiple air outlets serves to spread the air stream over a greater area, if desired. The use of multiple air outlets also serves to promote aesthetic designs hitherto unknown in the consumer market.

The disassociation of the impeller, heating element and other components from the location of the air outlet also minimizes the housing size required near the air outlet(s). This minimization of the housing size in the air outlet area thereby allows the air moving apparatus with improved air blending characteristics of embodiments of the current invention to entrain ambient air into the air flow produced by the device. As such, the device moves more room air through the device and more rapidly blends the air into the entire area or room.

The disassociation of the impeller and heating element from the location of the heated air outlet also allows the manufacturer to use the same impeller and heating element configuration regardless of the shape or location of the air outlet. As such, the heating element and impeller combination can be engineered for maximum efficiency and used in multiple device designs absent the need to re-engineer the performance characteristics of the impeller and heating element combination for each design. The multiple uses of a single impeller and heating element combination across various devices reduces development time required for each device. The potential high quantity use of the same impeller and heating element when used for multiple devise design facilitates high quantity manufacturing. High quantity manufacturing serves to lower the cost of these components, which in turn is an advantage to both the manufacturer and the consumer.

Another advantage of the present invention is the ability to locate the impeller, heating element, motor and other components of mass in a lower portion of the device. Lowering the center of gravity reduces the need for a large base to maintain the stability of the device. This thereby minimizes the planar footprint of the device and reduces the floor space or desk space required.

The end user is the beneficiary of a fully functional air moving apparatus that occupies less planar area than conventional devices and includes advanced ambient air flow entrainment.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following Figures.

DETAILED DESCRIPTION

Figure 1:
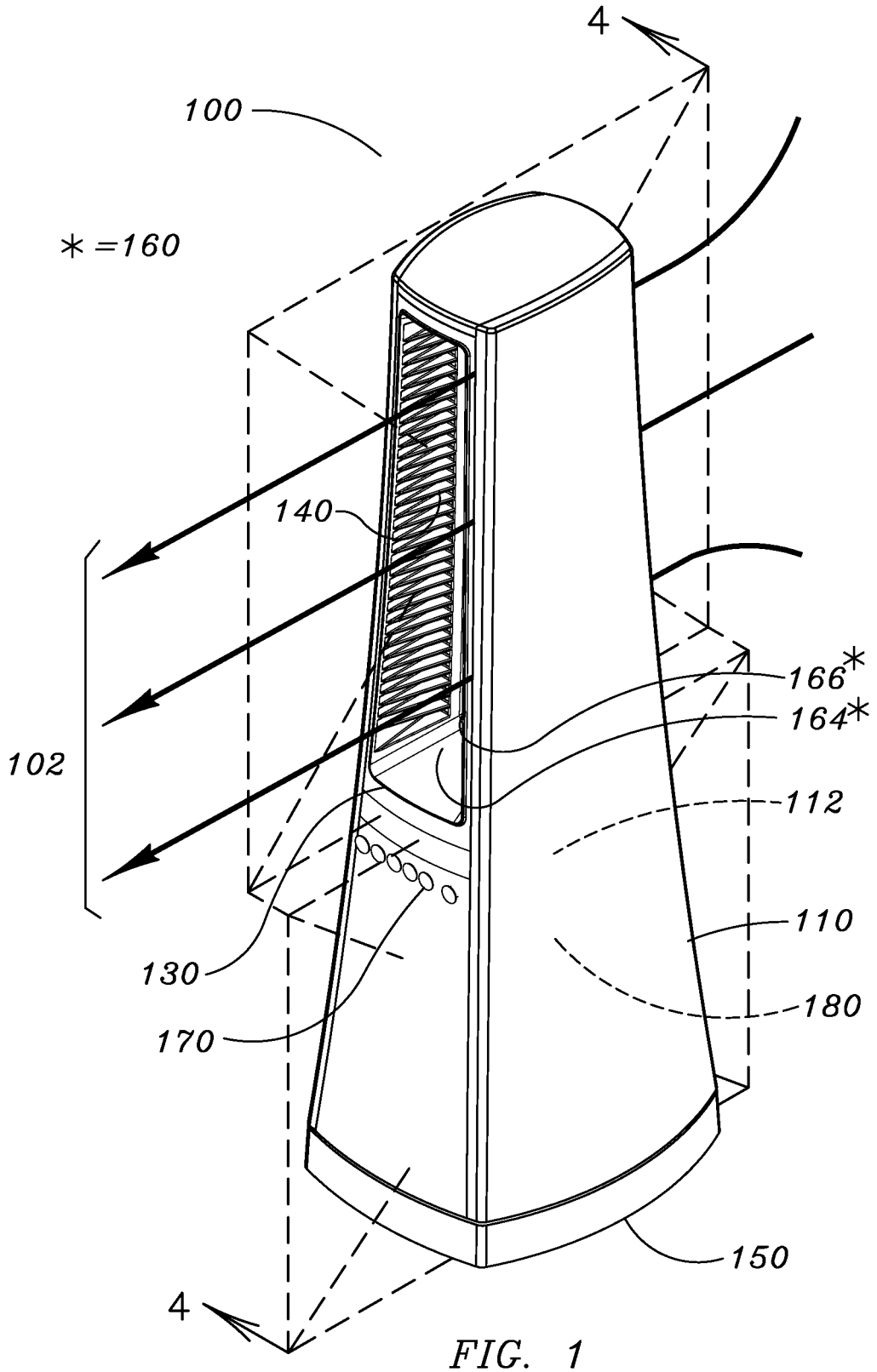
FIG. 1 is a front perspective view of an air moving apparatus with improved air blending, according to an embodiment of the present invention.
Figure 2:
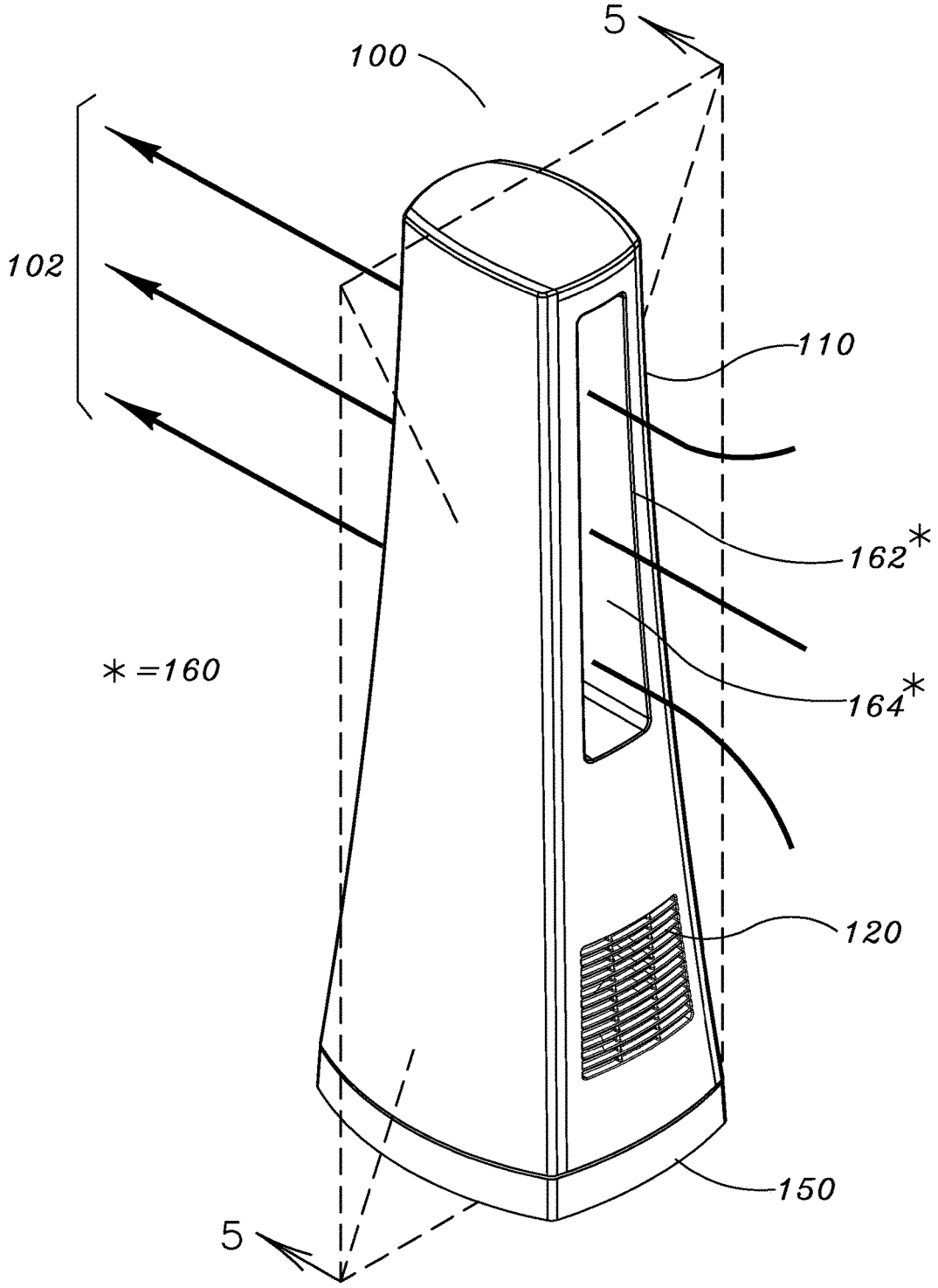
FIG. 2 is a rear perspective view of the embodiment of FIG. 1.

FIG. 1 and FIG. 2 are front and rear perspective views, respectively, of an air moving apparatus with improved air blending 100, according to an embodiment. In this embodiment, housing 110 has a vertical aspect ratio and includes air inlet 120, air outlet 130, and ambient air passageway 160. Ambient air passageway 160 includes rear opening 162, air pathway 164, and front opening 166, which facilitate the passage of ambient air 102 through housing 110. Housing 110 defines first interior space 112. Base 150 is used to maintain housing 110 in a vertical and upright position, and air flow generator 180 is located within first interior space 112. According to an embodiment, as shown in FIG. 1, control interface 170 is located on a front portion of housing 110. Also shown in FIG. 1 is section plane 4-4 which corresponds to FIG. 4; and FIG. 2 shows section plane 5-5 which corresponds to FIG. 5.

Figure 3:
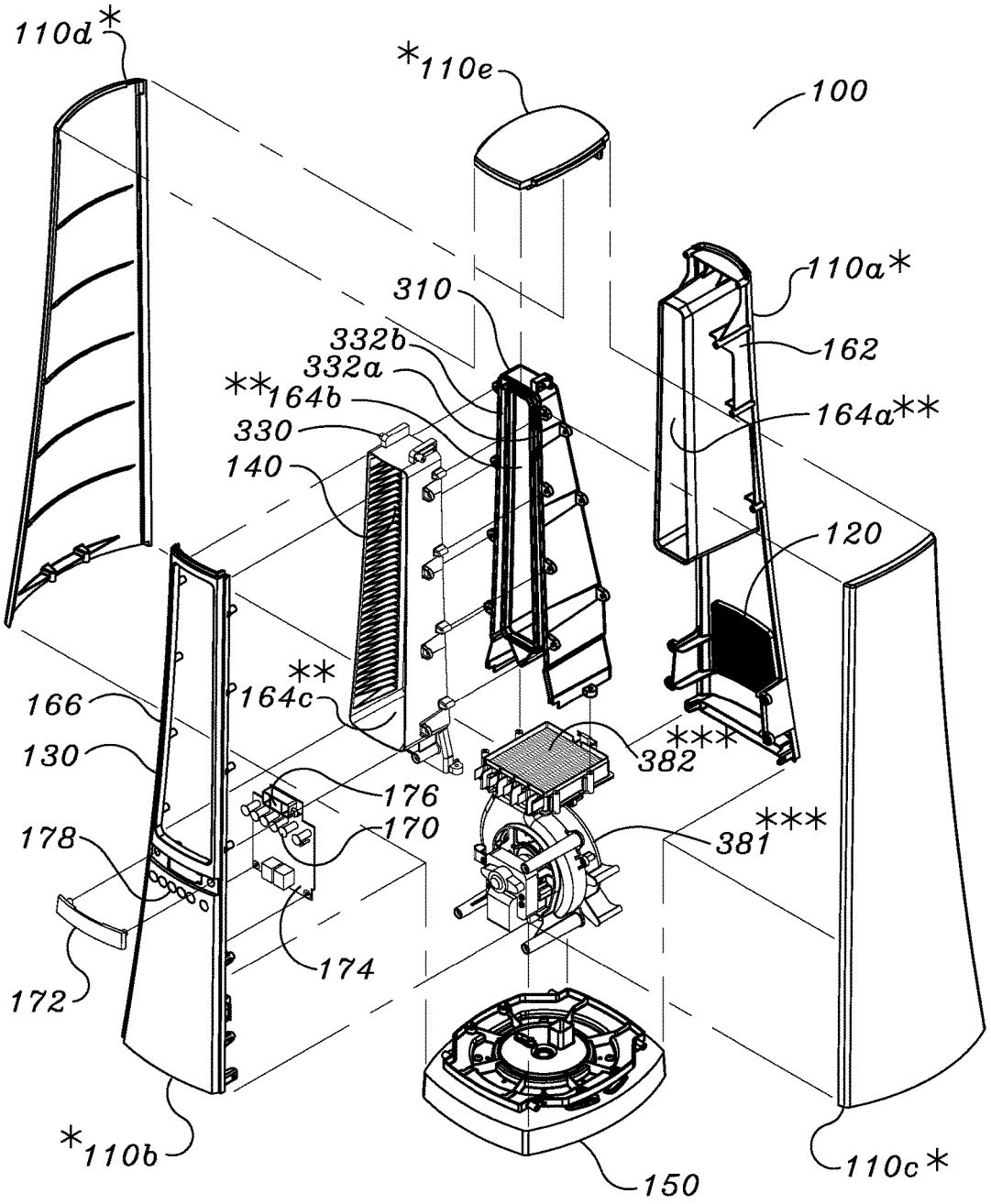
FIG. 3 is an exploded perspective view of the embodiment of FIG. 1.

FIG. 3 is an exploded perspective view of air moving apparatus with improved air blending 100 of FIG. 1. Housing 110 includes rear housing 110*a*, front housing 110*b*, right side housing 110*c*, left side housing 110*d*, and housing top 110*e*. Located within housing 110 are: air generator 381, electric heating element 382, and plenum 310. Plenum 310 includes multiple outlets: plenum outlet 332*a*, plenum outlet 332*b* which correspond to air directing fins 140 located on plenum cover 330.

As shown, rear opening 162 of ambient air passageway 160 is located in rear housing 110*a*, while front opening 166 of ambient air passageway 160 is located in front housing 110*b*. Front opening 166 corresponds with air outlet 130. Air pathway 164 connects rear opening 162 to front opening 166 and includes portion 164*a*, portion 164*b*, and portion 164*c*, which are part of rear housing 110*a*, plenum 310, and plenum cover 330, respectively. As shown, plenum outlet 332*a*, plenum outlet 332*b* of plenum 310 and air directing fins 140 located on plenum cover 330 are located on opposite sides of air pathway 164.

Also shown are control interface 170 and digital readout 176 mounted to power control board 174. Digital readout 176 is visible through control window 172 located on front housing 110*b*, and control interface 170 is accessible through holes 178 located on front housing 110*b*.

Figure 4:
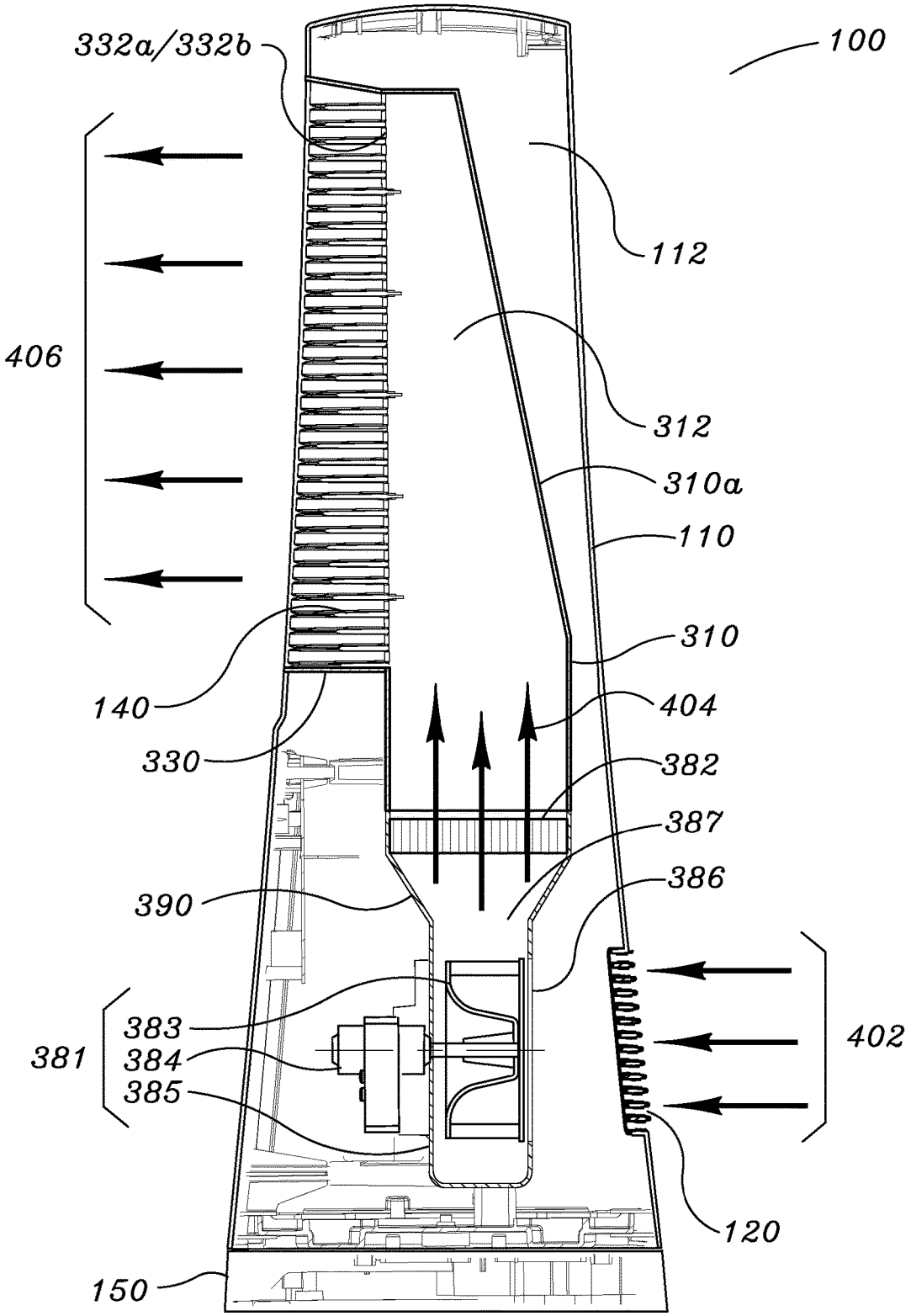
FIG. 4 is a right side section view of the embodiment of FIG. 1.

FIG. 4 is a right side section view along section plane 4-4 of FIG. 1. As shown, air generator 381 includes impeller 383, motor 384 and scroll housing 385. Intake air is drawn into interior space 112 along first flow path 402 and into scroll housing intake port 386, and is subsequently expelled through scroll housing exit port 387 along second flow path 404. Heating element 382 is located along second flow path 404 and heats the air as it passes therethrough. The heated air enters second interior space 312 defined by plenum 310 and subsequently exits plenum 310 through plenum outlet 332*a* and plenum outlet 332*b*. The heated air exits air moving apparatus with improved air blending 100 along third flow path 406. Heating the flow of air via heating element 382, prior to entering the plenum 310, also allows natural convection to aid the flow of the heated air stream into second interior space 312.

Transition 390 is utilized to adapt the size and shape of exit port 387 to the size and shape of heating element 382. Transition 390 and the conformance of the lower portion of plenum 310 to the size of heating element 382 facilitates the free flow of air through heating element 382 by eliminating impediments to air flow along second flow path 404. The free flow of air is important to achieve the proper thermal transfer for air moving apparatuses that utilize positive temperature coefficient (PTC) type elements. As shown, the walls of plenum 310 are straight in the area around heating element 382 and do not inhibit the flow of air along second flow path 404. It is contemplated that the walls of plenum 310 in the area of heating element 382 may also diverge from one another. Although heating element 382 is shown as a PTC element, the invention is not so limited. It is contemplated that nickel-chrome hot wire, quartz heaters, and the like could be used as in lieu of a PTC type element.

Rear wall 310*a* of plenum 310 inclines toward plenum outlet 332*a* and plenum outlet 332*b* as the distance from heating element 382 increases. This feature assures that air exits across the length of plenum outlet 332*a* and plenum outlet 332*b*. The incline of rear wall 310*a* also facilitates the directional transition of air flow between second flow path 404 and third flow path 406.

Air directing fins 140 located on plenum cover 330 are located proximate plenum outlet 332*a* and plenum outlet 332*b* and serve to maintain a substantially straight vector flow of air along third flow path 406. Maintaining a straight vector flow increases the distance that an exhaust air stream flowing along third flow path 406 is able to travel after exiting air moving apparatus with improved air blending 100. The increased distance of travel will increase the penetration of heated exhaust air steam into the room. As shown, air directing fins 140 are external to plenum 310.

It is contemplated that power control board 174 could be so configured to allow heating element 382 to be de-energized while maintaining the functionality of impeller 383 and motor 384. In this manner, the device can be used as a heating and/or a cooling device.

Figure 5:
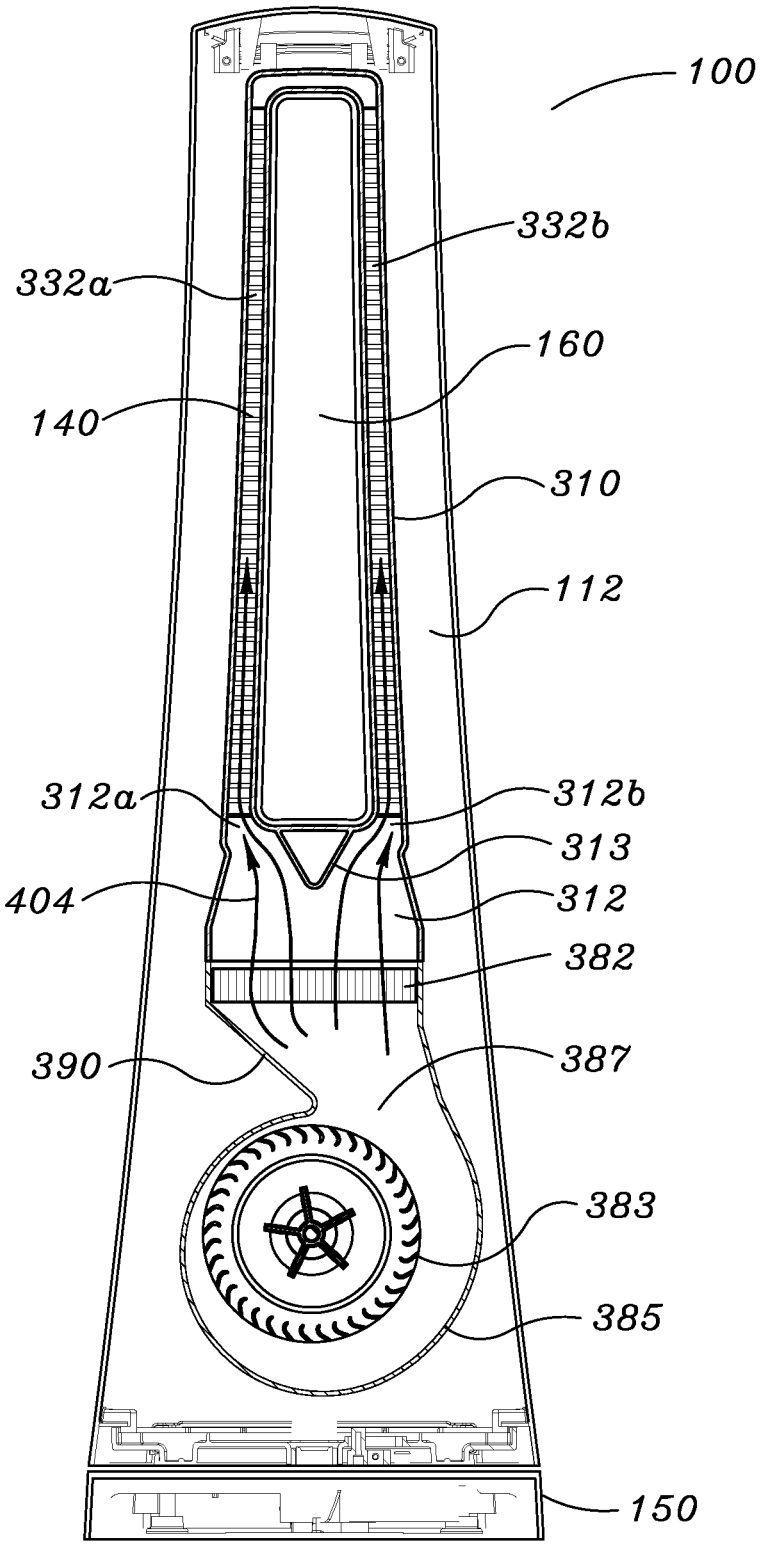
FIG. 5 is a rear section view of the embodiment of FIG. 1.

FIG. 5 is a rear section view along section plane 5-5 of FIG. 2. Second interior space 312 is divided into air channel A 312*a* and air channel B 312*b*. Second air flow path 404 is divided by flow divider 313 as the flow of heated air enters air channel A 312*a* and air channel B 312*b*. As can be seen, plenum outlet 332*a* and plenum outlet 332*b* are located on opposite sides of ambient air passageway 160. Similar to the incline of rear wall 310*a* of plenum 310 (see FIG. 4), the width of air channel A 312*a* and air channel B 312*b* may narrow as the distance from heating element 382 increases. This feature also promotes air to exit across the length of plenum outlet 332*a* and plenum outlet 332*b*.

Referring to both FIGS. 4 and 5, heated air exiting plenum outlet 332*a* and plenum outlet 332*b* located on opposite sides of ambient air passageway 160 entrain ambient air flow 102 to flow through ambient air passageway 160. As heated air exits plenum outlet 332*a* and plenum outlet 332*b* along third flow path 406, it efficiently blends with ambient air flow 102, thereby more rapidly mixing the heated air into the entire area or room.

As shown in FIG. 5, air channel A 312*a* and air channel B 312*b* join at the top of plenum 310, while plenum outlet 332*a* and plenum outlet 332*b* correspond only to opposite sides of ambient air passageway 160. The invention is not limited by either of these aspects. It is contemplated that air channel A 312*a* and air channel B 312*b* may not join at the top or may alternatively be separated by a wall. It is also contemplated that plenum outlet 332*a* and plenum outlet

332*b* may join at the top of plenum 310 and heated air could also exit along the top of air passageway 160.

The structuring of plenum 310 as described minimizes flow impediments along second flow path 404. The absence of flow impediments allows the device to utilize lower pressures to move air efficiently through the device. In short, the need for high pressure and compression type air generators associated with these higher pressures is eliminated. The elimination of the need of a compression type air generator allows the manufacturer to use less expensive components, yielding a more affordable device for the end user.

It has been found that the relationship of the flow through area of heating element 382, the combined flow through area of plenum outlet 332*a* and plenum outlet 332*b*, and the volume air channel A 312*a* and air channel B 312*b* have a direct effect on the ability of heating element 382 to efficiently impart thermal energy into the air flowing along second flow path 404. As the combined flow through area of plenum outlet 332*a* and plenum outlet 332*b* is decreased as a proportion of the flow through area of heating element 382, the volume of air channel A 312*a* and air channel B 312*b* may be increased to allow sufficient expansion of the air moving along second flow path 404 subsequent to heating element 382. The expansion of the air prior to outlet 332*a* and plenum outlet 332*b* decreases the impediment of air flow in the entire system.

Figure 6:
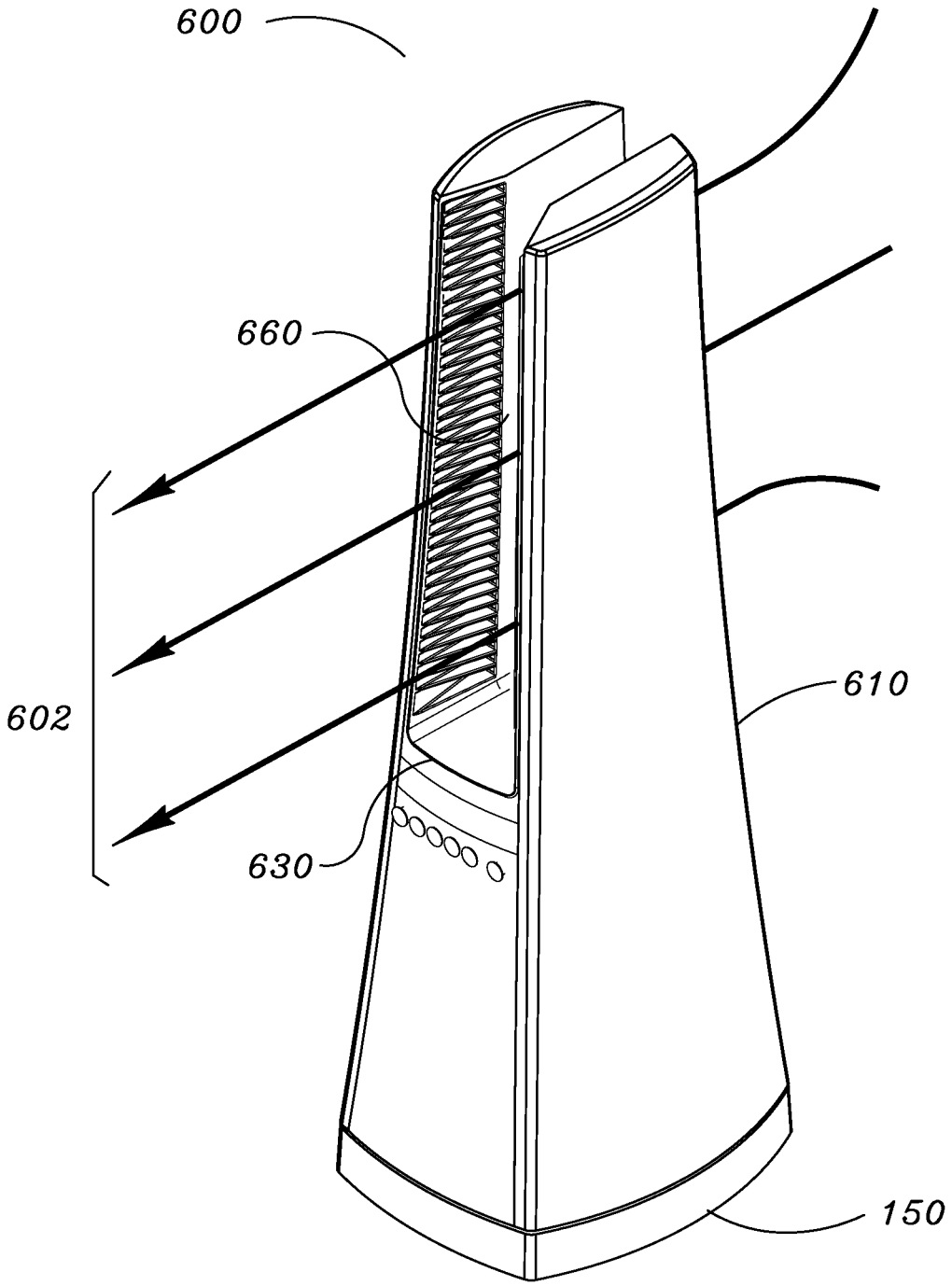
FIG. 6 is a front perspective view of an air moving apparatus with improved air blending, according to an additional embodiment.

FIG. 6 is a front perspective view of another embodiment of an air moving apparatus with improved air blending 600. As shown, ambient air passageway 660 is not fully enclosed on all sides by housing 610. Similar to ambient air flow 102 of the embodiment of FIG. 1, ambient air flow 602 is efficiently blended with the air as it exits the device through air outlet 630. In all other respects, air moving apparatus with improved air blending 600 is similar to air moving apparatus with improved air blending 100.

Figure 7:
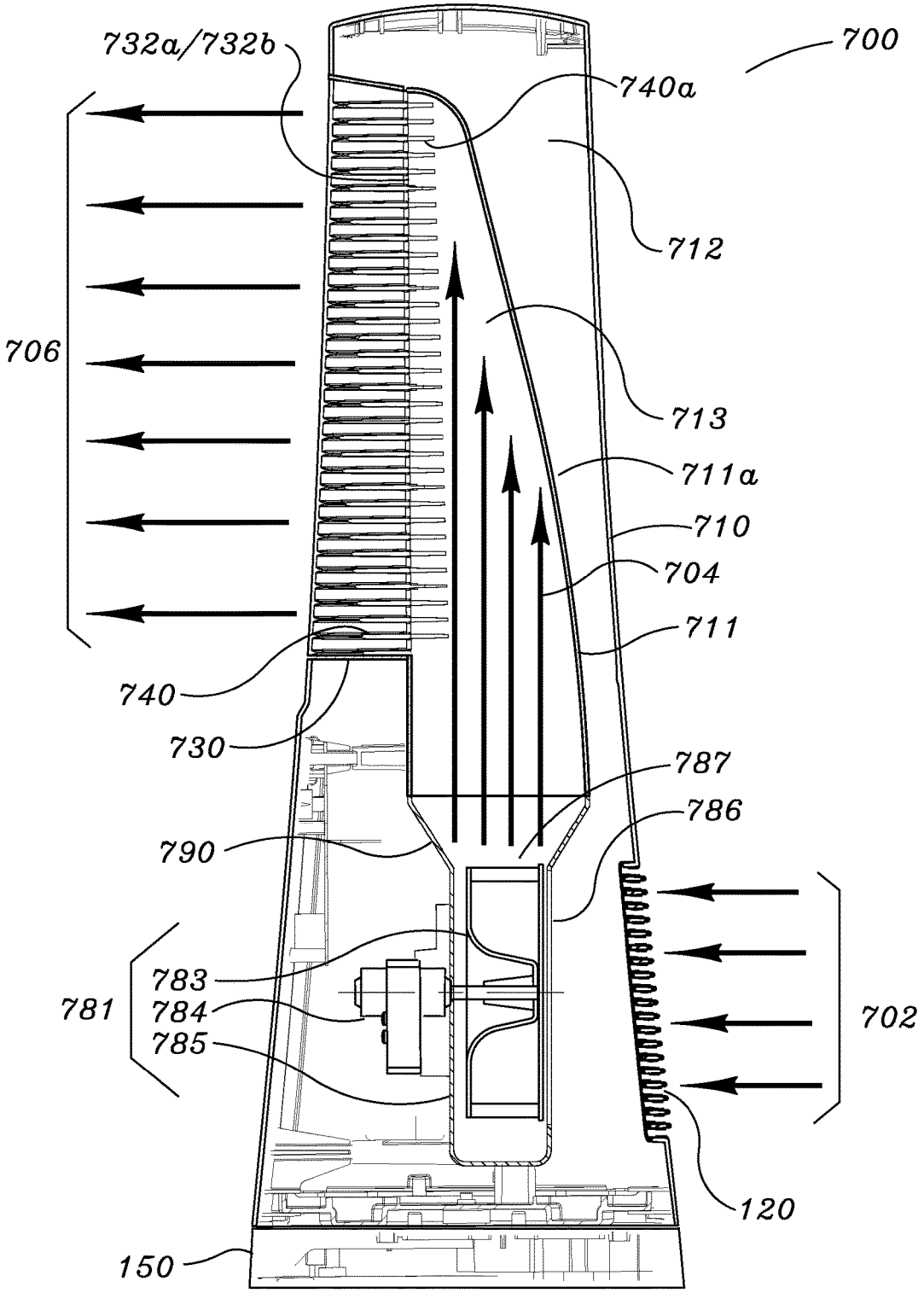
FIG. 7 is a right side section view of another embodiment of an air moving apparatus with improved air blending.

FIG. 7 is a right side section view of air moving apparatus improved air blending 700, according to an additional embodiment. Intake air is drawn into interior space 712 of housing 710 along first flow path 702 and into scroll housing intake port 786 and subsequently expelled through scroll housing exit port 787 along second flow path 704. The air enters second interior space 713 defined by plenum 711 and subsequently exits plenum 711 through plenum outlet 732*a* and plenum outlet 732*b*. The air exits air moving apparatus with improved air blending 700 along third flow path 706. Transition 790 adapts the form of exit port 787 to a lower portion of plenum 711.

Unlike air moving apparatus with improved air blending 100 of FIG. 4, air moving apparatus with improved air blending 700 is absent a heating element. The removal of the heating element from the structure permits the use of air generator 781, which includes impeller 783 (having a larger diameter relative to impeller 383 of FIG. 4), motor 784, and scroll housing 785. Impeller 783 can thereby generate an air flow along second flow path 704 having a greater velocity relative to the air velocities associated with the embodiment of FIG. 4.

Air directing fins 740 associated with plenum cover 730 include extension portion 740*a*. It has been found that an even distribution of a higher velocity air flow across the vertical length of plenum outlet 732*a* and plenum outlet 732*b* is enhanced by extension portions 740*a*. As shown, extension portions 740*a* project the surfaces of air directing fins 740 into second interior space 713, which aids in the transition of the high velocity air from second flow path 704 to third flow path 706. The even distribution of a higher velocity air flow across the vertical length of plenum outlet 732*a* and plenum outlet 732*b* improves the entrainment of ambient air into and through ambient air passageway 160.

Plenum 711 includes rear plenum wall 711*a* having a gradual and curved form. The form of rear plenum wall 711*a* provides a smooth transition between second flow path 704 and third flow path 706. These features further improves the ability of air moving apparatus with improved air blending 700 to deliver a higher velocity air flow along third flow path 706 relative to the structure of air moving apparatus with improved air blending 100 of FIG. 4. In all other respects, air moving apparatus with improved air blending 700 is similar to air moving apparatus with improved air blending 100.

Figure 8:
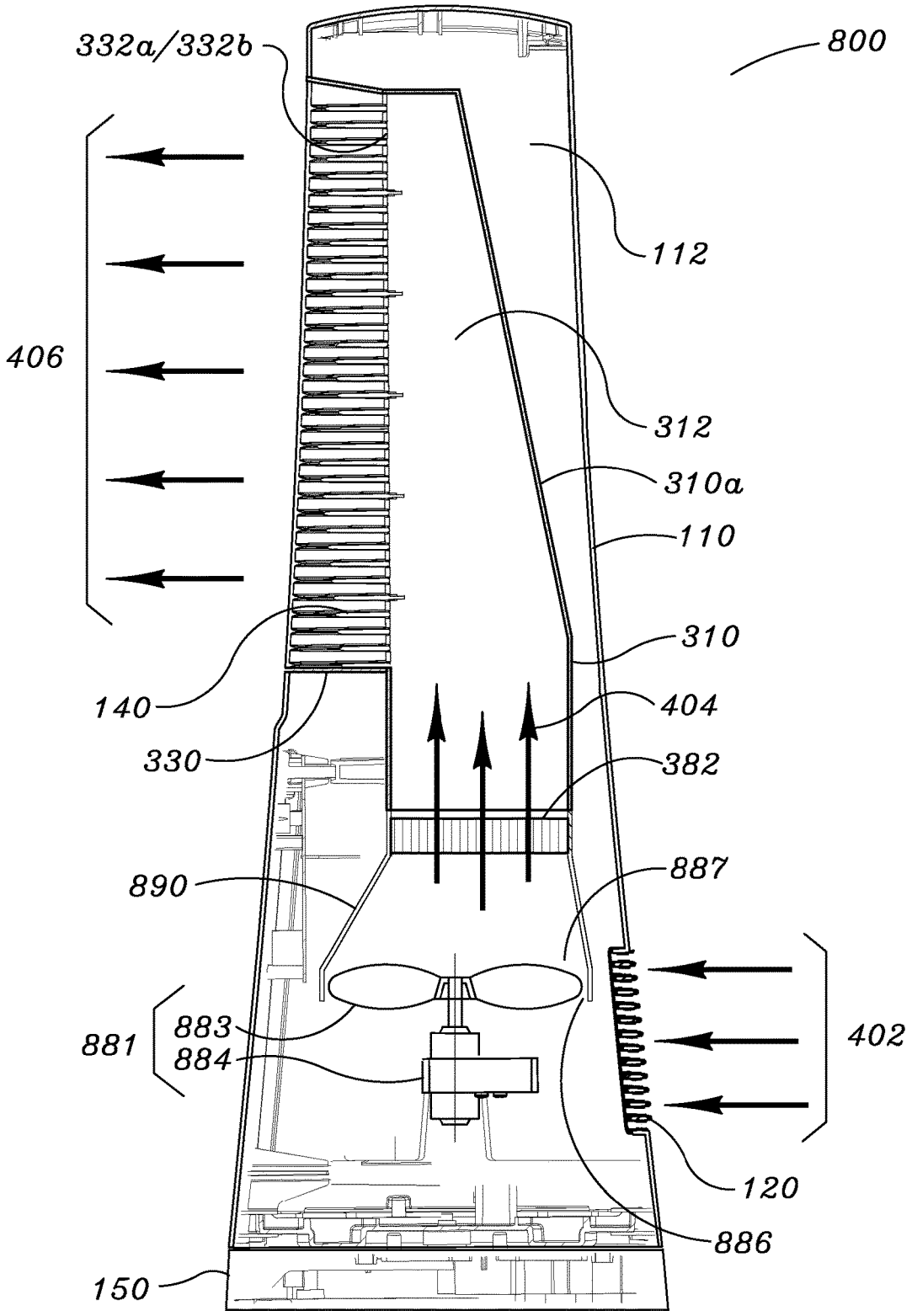
FIG. 8 is a right side section view of yet another embodiment of an air moving apparatus with improved air blending.

FIG. 8 is a right side section view of air moving apparatus with improved air blending 800, according to yet another embodiment. Unlike air moving apparatus with improved air blending 100 of FIG. 4, air generator 881 includes axial impeller 883 and motor 884. Intake air is drawn into interior space 112 along first flow path 402 and into fan intake port 886 and subsequently expelled through fan exit port 887 along second flow path 404. As can be seen, air generator 881 utilizes axial impeller 883 in lieu of centrifugal type impeller 383 of the embodiment of FIG. 4. Transition 890 functions similarly to transition 390 of the embodiment of FIG. 4. In all other respects, air moving apparatus with improved air blending 800 is similar to air moving apparatus with improved air blending 100.

It is contemplated that conventional assembly methods can be used to secure the components associated with air moving apparatus with improved air blending 100, 600, 700, and 800. Methods and devices such as screws, adhesives, snap fits, press fits, ultrasonic welding, heat welding, Velcro, tape, and the like may be used without departing from the spirit of the invention.

As shown, the disassociation of the impeller, heating element, and other components from the location of air outlet(s) 130 and 630 minimizes the size of housing(s) 110, 610, and 710 required near the air outlet(s). This minimization of the housing size allows the air moving apparatus with improved air blending 100, 600, 700, and 800 to more efficiently entrain ambient air into the air flow via ambient air passageways 160 and 660.

Aspects of the present invention result in the ability to locate the impeller, heating element, motor, and other heavy components in a lower portion of the device, providing an effectual method of lowering the center of gravity of the device. This in turn reduces the need for a large base to maintain the stability of the device. The reduced planar footprint of air moving apparatus with improved air blending 100, 600, 700, and 800 reduces the floor space or desk space required.

Although the apparatuses 100, 600, 700, and 800 are shown and described to have a vertical aspect ratio with a vertically-oriented air outlet 130 and 630, the invention is not so limited and other shapes, configurations, and/or forms may be implemented. For example, the apparatus may be square or substantially square with a substantially horizontal air outlet near a top portion of the housing. As another example, the apparatus may have a horizontal aspect ratio with a horizontally-oriented air outlet. In such an embodiment, the apparatus may have multiple air outlets and corresponding air flow generators; for example, one at each end of the apparatus.

Although the present invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

We claim:

1. A portable air moving apparatus comprising:

a housing comprising at least one housing wall, said at least one housing wall defining a first interior space;

an air flow generator located within said first interior space;

a plenum located within said first interior space comprising plenum walls located within said first interior space, said plenum walls defining a second interior space and comprising multiple air channels;

at least one plenum outlet associated with said multiple air channels, wherein the at least one plenum outlet is located in a front half of said second interior space;

an ambient air passageway comprising an opening passing between a rear portion of said housing and a front portion of said housing wall of said housing and located between said multiple air channels of said plenum;

an air inlet in said housing allowing air to enter said first interior space;

an air outlet in said housing located in a front half of said housing wall and adjacent to a perimeter of said ambient air passageway and in fluid communication with said second interior space via said at least one plenum outlet;

wherein said air flow generator draws an intake air flow into said housing through said air inlet, into said second interior space and subsequently expels an exhaust air flow from said housing through said air outlet; and wherein said exhaust air flow entrains a flow of ambient air which passes through said ambient air passageway from said rear portion of said housing toward said front portion of said housing.

2. The portable air moving apparatus of claim 1, wherein the at least one plenum outlet comprises multiple plenum outlets located on opposite sides of said ambient air passageway.

3. The portable air moving apparatus of claim 1, further comprising multiple planar air directing structures spaced apart relative to one another along a length of said at least one plenum outlet.

4. The portable air moving apparatus of claim 1, further comprising a base portion contacting a mounting surface, wherein said plenum is located above said base portion, and wherein said air flow generator is located between said base portion and said plenum and is fluidly connected to said plenum.

5. The portable air moving apparatus of claim 1, further comprising:

a first flow path of said intake air flow entering said first interior space;

a second flow path of air exiting said air flow generator and entering said second interior space;

a third flow path of said exhaust air flow exiting said housing; and wherein said second flow path is orthogonal to said first flow path and said third flow path.

6. The portable air moving apparatus of claim 5, wherein said air flow generator comprises:

a motor;

an impeller;

a scroll housing;

an intake port; and an exit port.

7. The portable air moving apparatus of claim 6, further comprising a heating element located between said exit port and said plenum, wherein said second flow path passes through said heating element prior to entering said plenum.

8. The portable air moving apparatus of claim 1, further comprising a heating element located within said first interior space between said air inlet and said air outlet.

9. The portable air moving apparatus of claim 8, wherein each of said air channels further comprises a bottom front to back dimension, and wherein said bottom front to back dimension is substantially equal to a front to back dimension of said heating element.

10. The portable air moving apparatus of claim 1, wherein each of said air channels further comprises a bottom front to back dimension and a top front to back dimension, and wherein said bottom front to back dimension is greater than said top front to back dimension of each respective air channel.

11. The portable air moving apparatus of claim 1, wherein each of said air channels further comprises a bottom side to side dimension and a top side to side dimension, and wherein said bottom side to side dimension is greater than said top side to side dimension of each respective air channel.

12. The portable air moving apparatus of claim 1, wherein the plenum walls include a rear wall that inclines toward the at least one plenum outlet.

13. The portable air moving apparatus of claim 6, wherein the impeller is a centrifugal impeller and includes an axis of rotation which is parallel to the flow of ambient air through said ambient air passageway.

* * * * *